US005279344A

United States Patent [19]

Rautio

[11] Patent Number: 5,279,344

[45] Date of Patent: Jan. 18, 1994

[54] CIRCULAR SAW BLADE ASSEMBLY

[76] Inventor: Kauko Rautio, Kolmihaarantie 1, 52700 Mäntyharju, Finland

[21] Appl. No.: 853,759

[22] PCT Filed: Dec. 5, 1990

[86] PCT No.: PCT/FI90/00291

§ 371 Date: Jun. 4, 1992

§ 102(e) Date: Jun. 4, 1992

[87] PCT Pub. No.: WO91/08875

PCT Pub. Date: Jun. 27, 1991

[30] Foreign Application Priority Data

Dec. 20, 1989 [FI] Finland ..... 896146

[51] Int. Cl.[5] ..... B27B 33/00

[52] U.S. Cl. ..... 144/223; 144/39; 144/218; 144/374; 144/41

[58] Field of Search ..... 144/39, 41, 218, 223, 144/374, 375

[56] References Cited

U.S. PATENT DOCUMENTS

| | | | |
|---|---|---|---|
| 1,167,801 | 1/1916 | De Laney | 144/223 |
| 3,630,244 | 12/1971 | Cromeens | 83/665 |
| 4,266,584 | 5/1981 | Lomnicki | 144/39 |
| 4,456,045 | 6/1984 | Gregoire | 144/39 |
| 5,143,127 | 9/1992 | Rautio | 144/39 |

FOREIGN PATENT DOCUMENTS

| | | |
|---|---|---|
| 881402 | 3/1988 | Finland . |
| 8702297 | 4/1987 | World Int. Prop. O. . |

*Primary Examiner*—W. Donald Bray
*Attorney, Agent, or Firm*—Lorusso & Loud

[57] ABSTRACT

The present invention concerns a circular saw blade assembly for a saw mill or similar apparatus used for sawing boards from logs, said circular saw blade assembly comprising at least two circular saw blades attachable to and axially transferrable on a saw blade spindle as well as one or several edge milling cutters for shaping the board to a correct width. The circular saw blade assembly in accordance with the invention is implemented so that the edging cutter is formed by edge cutter elements adapted to adjacent circular saw blades, whereby the cutter elements are axially adjustable in relation to each other along with the spacing adjustment of the circular saw blades and each cutter element is comprised of one or several cutter knives and a block section having a recess machined to its face opposing the adjacent cutter element and having a penetrating hole for the saw spindle to pass, whereby the knives of the adjacent cutter elements are aligned to rotate along a single circle with an axial displacement of the elements at the different points along the cutting circle.

10 Claims, 1 Drawing Sheet

CIRCULAR SAW BLADE ASSEMBLY

FIELD OF INVENTION

The present invention concerns a circular saw blade assembly for a saw mill or similar apparatus used for sawing boards from logs, said circular saw blade assembly comprising at least two circular saw blades attachable to and axially transferrable on a saw blade spindle as well as one or several edge milling cutters for shaping the board to a correct width.

BACKGROUND OF THE INVENTION

Known in the art is a method for placing several circular saw blades axially transferrably on a common shaft (U.S. Pat. No. 3,630,244). This arrangement has a drawback in that the gap between the adjacent circular saw blades does permit the placement of edge shaping cutters to correct width for the trimming of the boards, but instead, the milling of the edge must be performed as a separate workphase.

Also known in the art is an arrangement in which the edging of the log prior sawing is unnecessary and which makes the axial adjustment of spacing between the saw blades possible. One such implementation is disclosed in FI patent application 881402. The system described in the application comprises a circular saw blade assembly which has two circular saw blades on a spindle and the spindle hubs are further designed to act as cutters, whereby the cutter attached to the inner circular saw blade is formed into a cage supporting by its end side an inner circular saw blade, and the inner cutter supporting an outer circular saw blade by its end side is located axially transferrable inside the cage-like cutter and extends through the center hole of the inner circular saw blade.

Such an axially adjustable circular saw blade assembly has only two circular saw blades, whereby only a wane and a slab can be cut from a log. The construction of the circular saw blade assembly is complicated, thereby leading to high costs. One of the cutters has constantly a maximum width, which causes wasteful use of log material, and correspondingly, to unnecessary growth of expenses. In addition, the diametrical difference of the cutters is small, which limits their useful operating range.

SUMMARY OF THE INVENTION

It is an object of the present invention to achieve a circular saw blade assembly capable of overcoming the above-described drawbacks. The assembly in accordance with the invention is characterized in that the edging cutters are formed by cutter elements adapted to adjacent circular saw blades so that the elements are axially adjustable in relation to each other and the cutter elements are comprised of one or several cutter knives and a block section having a recess machined into the face opposing the adjacent cutter element and having a penetrating hole for the saw spindle to pass, whereby the knives of the adjacent cutter elements are aligned to rotate along a single circle with an axial displacement of the elements at the different points along the cutting circle.

A preferred embodiment of the assembly in accordance with the invention is characterized in that both cutter elements are comprised of two diametrically oppositely placed cutter knives and that the adjacent cutter elements are phase-shifted by a 90° angle.

Another preferred embodiment of the method in accordance with the invention is characterized in that both cutter elements are comprised of three cutter knives diametrically spaced at 120° angle and that the adjacent cutter elements are phase-shifted by 60° angle.

A further preferred embodiment of the method in accordance with the invention is characterized in that the cutter elements are attached to the circular saw blade by screw clamps and that the surface of the cutter element facing the circular saw blade is flat.

The circular saw blade assembly in accordance with the invention offers an improved support of the blade between the flanges. All circular saw blades of the assembly are axially movable, whereby the edge cutter elements are simultaneously adjusted correspondingly, thus making it easy to alter the thickness of the board to be sawn without a need for changing the edge cutter elements. The construction of the assembly is simple and the edge cutter elements are replaceable, whereby the operation and maintenance of the assembly becomes advantageous. The diameter of an edge cutter element is not dependent on that of the other edge cutter elements, thus allowing for a free alteration of the element diameters. The number of the circular saw blades in the circular saw blade assembly in accordance with the invention is not limited, but instead, the same saw spindle can have several circular saw blades and independently operating edge cutter elements placed on it.

BRIEF DESCRIPTION OF THE DRAWINGS

In the following, the invention will be examined in more detail with the help of a preferred exemplifying embodiment with reference to the attached drawings, in which.

DESCRIPTION OF THE PREFERRED EMBODIMENT

Figure 1:
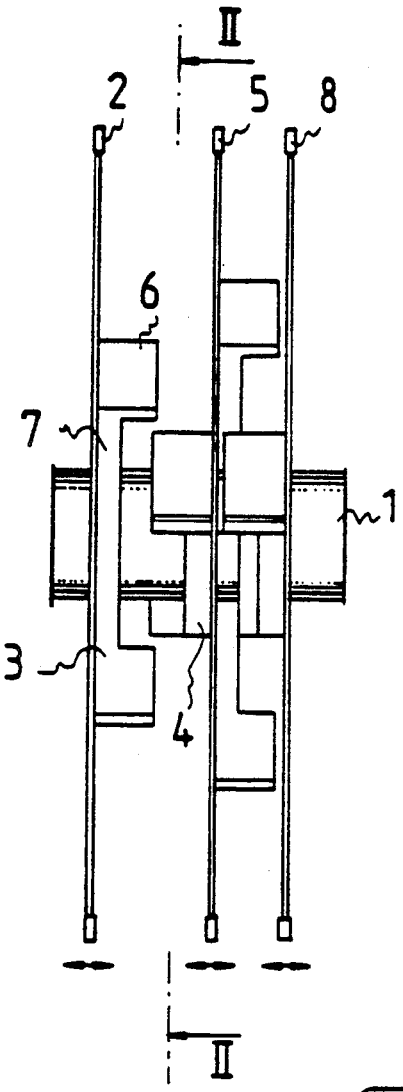
FIG. 1 shows in a side view a circular saw blade assembly in accordance with the invention.

FIG. 1 shows a circular saw blade assembly comprising three circular saw blades 2, 5, 8 mounted on a saw spindle 1. Attached to the circular saw blades 2, 5, 8 are edge cutter elements 3. The pair of adjacent cutter elements 3, 4 forms an edge cutter. The edge cutter is axially adjustable along with the variable spacing of the circular saw blade 2, 5. An essential characteristic of the invention is that the cutter knives 6 of the edge cutter elements 3, 4 rotate axially coincidingly aligned along the same circle when the edge cutter is adjusted for minimum width, while the side edge of the cutter knife 6 of the cutter element 3 facing the cutter element 4 rotates axially coincidingly aligned with the side edge of the cutter knife 6 of the cutter element 4 facing the cutter element 3 when the edge cutter is adjusted for maximum width. Thus, for instance, when thicker boards are to be sawn, the circular saw blade 5 is moved farther away from the circular saw blade 2. Then, the edge cutter element 4 moves along with the circular saw blade 5, whereby the cutting width of the edge cutter is altered correspondingly. The cutter illustrated in the diagram between the circular saw blades 2 and 5 is shown adjusted to a nearly maximum width. Conversely, the cutter between the circular saw blades 5 and 8 is shown adjusted to a nearly minimum width.

Figure 2:
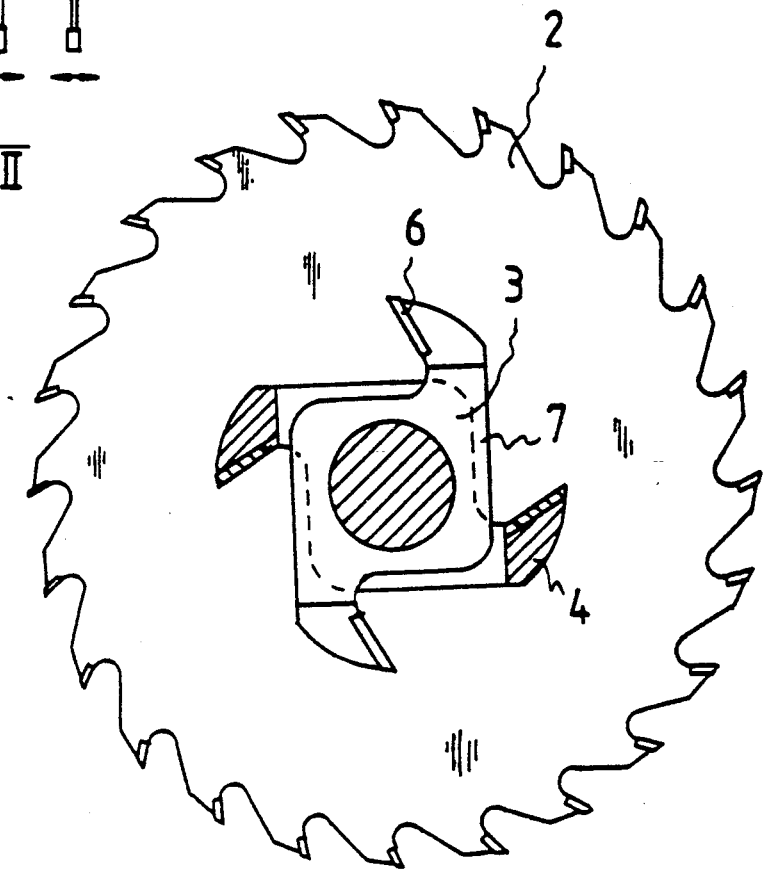
FIG. 2 shows the assembly illustrated in FIG. 1 sectioned along line II—II.

FIG. 2 shows the circular saw blade 2, the edge cutter element 3 and the edge cutter element 4 attached to the adjacent circular saw blade in partially sectional view. The cutter knives 6 of the edge cutter elements 3, 4 are diametrically opposed on the same circle and the two cutter elements are phase-shifted by 90°.

For those versed in the art, it is obvious that the invention is not limited to the exemplifying embodiments described above; by contrast, the invention can be varied within the claims disclosed herein.

What is claimed is:

1. A circular saw blade assembly for a saw mill or similar apparatus used for sawing boards from logs, said circular saw blade assembly comprising:

a saw blade spindle having an axis;

at least two circular saw blades, each said circular saw blade both being attached to said saw blade spindle and being axially movable along the saw blade spindle axis so that said circular saw blades are spaced from each other to saw the logs into boards;

at least one edging cutter, one edging cutter for each pair of opposing circular saw blades and being disposed between each said pair of opposing circular blades;

wherein each said edging cutter further includes two edge cutter elements, each said edge cutter element having an aperture through which said saw blade spindle passes;

wherein one said edge cutter element of each said edge cutter is secured to tone circular saw blade of each said pair of opposing circular saw blades and the other said edge cutter element of said edge cutter is secured to the other circular saw blade of each said pair of opposing circular saw blades;

wherein each said edge cutter element of each said edge cutter is secured to a circular saw blade so each said edge cutter element is adjusted with respect to each other and along the saw blade spindle axis when he secured to circular saw blade is moved axially, thereby adjusting said edging cutter to shape a board to a correct width;

each said edge cutter element having at least one cutter knife and a block section, said block section having a recess machined in its face that opposes said edge cutter element secured to the opposing circular saw blade of said pair of opposing circular saw blades, where said edge cutter element aperture is disposed in said block section; and wherein each said cutter knife for both said edge cutter elements of each said edge cutter is aligned to rotate along a single circle and where each said cutter knife is circumferentially spaced from each other along the circle.

2. The circular saw blade assembly of claim 1, wherein each said edge cutter element has a plurality of cutter knives, where each said knife is aligned to rotate along a single circle and where said plurality of cutter knives, disposed in each said edge cutter element, are equiangularly and circumferentially spaced from each other along the circle.

3. The circular saw blade assembly of claim 1, wherein each said edge cutter element of each said edge cutter further includes two diametrically opposed cutter knives and wherein said edge cutter elements for each said edge cutter are phase-shifted by a 90° angle.

4. The circular saw blade assembly of claim 1, wherein each said edge cutter element of each said edge cutter further includes three cutter knives disposed in each said edge cutter element so that said knives are spaced from each other at a 120° angle and wherein said edge cutter elements for each said edge cutter are phase-shifted by a 60° angle.

5. The circular saw blade assembly of claim 1, wherein each said cutter element is secured to each said circular saw blade by screw clamps and where the surface of each said cutter element facing said circular saw blade is flat.

6. A circular saw blade assembly for a saw mill or similar apparatus used for sawing boards from logs, said circular saw blade assembly comprising:

a saw blade spindle having an axis;

three circular saw blades, each said circular saw blade both being attached to said saw blade spindle and being axially movable along the saw blade spindle axis so that said circular saw blades are spaced from each other to saw the logs into boards;

two edging cutter, where an edging cutter is disposed between each pair of opposing circular saw blades;

wherein each said edging cutter further includes two edge cutter elements, each said edge cutter element having an aperture through which said saw blade spindle passes;

wherein one said edge cutter element of each said edge cutter is secured to one circular saw blade of each said pair of opposing circular saw blades and the other said edge cutter element of said edge cutter is secured to the other circular saw blade of each said pair of opposing circular saw blades;

wherein each said edge cutter element of each said edge cutter is secured to a circular saw blade so each said edge cutter element is adjusted with respect to each other and along the saw blade spindle axis when the secured to circular saw blade is moved axially, thereby adjusting said edging cutter to shape a board to a correct width;

each said edge cutter element having at least one cutter knife and a block section, said block section having a recess machined in its face that opposes said edge cutter element secured to the opposing circular saw blade of said pair of opposing circular saw blades, where said edge cutter element aperture is disposed in said block section; and wherein each said cutter knife or both said edge cutter elements of each said edge cutter is aligned to rotate along a single circle and where each said cutter knife is circumferentially spaced from each other along the circle.

7. The circular saw blade assembly of claim 6, wherein each said edge cutter element has a plurality of cutter knives, where each said knife is aligned to rotate along a single circle and where said plurality of cutter knives, disposed in each said edge cutter element, are equiangularly and circumferentially spaced from each other along the circle.

8. The circular saw blade assembly of claim 6, wherein each said edge cutter element of each said edge cutter further includes two diametrically opposed cutter knives and wherein said edge cutter elements for each said edge cutter are phase-shifted by a 90° angle.

9. The circular saw blade assembly of claim 6, wherein each said edge cutter element of each said edge cutter further includes three cutter knives disposed in each said edge cutter element so said knives are spaced from each other at a 120° angle and wherein said edge cutter elements for each said edge cutter are phase-shifted by a 60° angle.

10. The circular saw blade assembly of claim 6, wherein each said cutter element is secured to each said circular saw blade by screw clamps and where the surface of each said cutter element facing said circular saw blade is flat.

* * * * *